US006153856A

United States Patent [19]

Lee

[11] Patent Number: 6,153,856

[45] **Date of Patent: *Nov. 28, 2000**

[54] LOW MAGNETIC FIELD EMITTING ELECTRIC BLANKET

[76] Inventor: Myoung Jun Lee, 16124 Rosecrans Ave., No. 16C, La Mirada, Calif. 90638

[ * ] Notice: This patent issued on a continued prosecution application filed under 37 CFR 1.53(d), and is subject to the twenty year patent term provisions of 35 U.S.C. 154(a)(2).

[21] Appl. No.: 09/192,957

[22] Filed: Nov. 16, 1998

Related U.S. Application Data

[63] Continuation-in-part of application No. 08/785,981, Jan. 27, 1997, Pat. No. 5,837,971.

[51] Int. Cl.[7] ..... H05B 1/00

[52] U.S. Cl. ..... 219/212; 219/544; 219/549

[58] Field of Search ..... 219/212, 528, 219/529, 538, 544, 546, 548, 549, 552; 338/214, 299, 302, 303, 321

[56] References Cited

U.S. PATENT DOCUMENTS

| | | | |
|---|---|---|---|
| 982,735 | 1/1911 | McElroy | 338/303 |
| 1,415,240 | 5/1922 | Hynes | 338/303 |
| 2,527,026 | 10/1950 | Mucher | 338/303 |
| 3,227,986 | 1/1966 | Serdahely et al. | 338/303 |
| 3,646,322 | 2/1972 | Speekman | 219/549 |
| 3,898,427 | 8/1975 | Levin et al. | 219/522 |
| 4,281,237 | 7/1981 | Berenson | 219/511 |
| 4,577,094 | 3/1986 | Mills | 219/212 |
| 4,742,212 | 5/1988 | Ishii et al. | 219/549 |
| 4,792,663 | 12/1988 | Kishimoto et al. | 219/549 |
| 4,885,456 | 12/1989 | Tanaka et al. | 219/497 |
| 4,910,391 | 3/1990 | Rowe | 219/549 |
| 5,170,043 | 12/1992 | Gunnufson | 219/528 |
| 5,218,185 | 6/1993 | Gross | 219/528 |
| 5,465,013 | 11/1995 | Basen et al. | 307/91 |
| 5,521,358 | 5/1996 | Eilentropp | 219/549 |

*Primary Examiner*—Teresa Walberg
*Assistant Examiner*—Fadi H. Dahbour
*Attorney, Agent, or Firm*—Lee & Hong; Jonathan Y. Kang

[57] ABSTRACT

An electric blanket used with a source voltage has a control device connected to the source voltage to control the source voltage in response to a predetermined temperature setting and a heating pad having a heating element arranged in the heating pad and connected to the output of the control device to generate heat. The heating element includes a first core, a first conductive element spirally wound around the first core, a second core arranged in surrounding relation to the first core and the first conductive element and a second conductive element spirally wound around the second core. The first ends of the first and second conductive elements are connected to the output of the control device and the second ends are connected to each other to define a conductive loop. The heating element further comprises an outer cover that covers the second core and the second conductive element and shields the internal components from external environment. The first conductive element comprises a third core and a conductive wire spirally wound around the third core. The conductive wire generates heat when electricity is applied.

20 Claims, 6 Drawing Sheets

LOW MAGNETIC FIELD EMITTING ELECTRIC BLANKET

This is a continuation-in-part of application Ser. No. 08/785,981 filed on Jan. 27, 1997, now U.S. Pat. No. 5,837,971.

BACKGROUND OF THE INVENTION

1. Field of the Invention

This invention relates to electrically heated blankets, and more particularly to low magnetic field emitting electrical blankets.

2. Description of Related Art

It has been discovered that electromagnetic field affect biological matter and, consequently, cause health problems in human. Such health problems may be linked to cancer and other ailments. The electromagnetic fields are very common in modern society where consumer electric appliances are frequently used at homes and offices. Commonly, electromagnetic fields are generated by power lines and transformers. The electric blankets or pads which we use to keep warm also generate one or more forms of electromagnetic field, which includes magnetic field. In fact, some studies have shown that there may be a direct correlation between electric blankets and certain medical conditions.

As it is well known that the electromagnetic field permeates through practically every kind of substances with the exception of ferromagnetic materials. Thus, attempting to block electromagnetic field in such appliances as electric blanket using ferromagnetic materials may not be practical due to its cost.

For example, FIG. 1 is a block diagram of a temperature controller and a heating element of a conventional electric blanket. The temperature controller 10 includes a bimetal thermostat switch 12 which can be set to appropriate temperatures to provide current to the heating element 20. Alternatively, as shown in FIG. 2, the temperature controller 10 may include an integrated circuit switch 14 instead of the thermostat switch 12 to provide the same function. The common characteristic of both FIGS. 1 and 2 is that the output voltage Vout at node 18 comprises a sinusoidal wave alternating current (AC). When using a conventional household line voltage, the Vout will be 60Hz wave with peak voltage slightly higher than 120V. The output voltage Vout is connected to the heating element 20. The heating element 20 is made with a resistive wiring 22 which produces heat when electricity is applied. Furthermore, the devices shown in FIGS. 1 and 2 use a resistive wiring 22 which is arranged to produce magnetic and electromagnetic field which may be harmful to human.

SUMMARY OF THE DISCLOSURE

It is an object of the present invention to provide an improved electric blanket or pad producing reduced magnetic field, preferably by arranging the resistive wiring used in the heating element to effectively cancel the magnetic field generated therefrom. The electromagnetic field may also be reduced by shielding the heating element of the electric blanket.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

According to a preferred embodiment of the present invention, an electric blanket is generally used with a source voltage having alternating current, such as a common household voltage. The electric blanket has a control device connected to the source voltage to control the source voltage in response to a predetermined temperature setting and a heating pad having a heating element arranged in the heating pad and connected to the output of the control device to generate heat. The heating element includes a first core, a first conductive element spirally wound around the first core, a second core arranged in surrounding relation to the first core and the first conductive element and a second conductive element spirally wound around the second core. The first ends of the first and second conductive elements are connected to the output of the control device and the second ends are connected to each other to define a conductive loop. The heating element further comprises an outer cover that covers the second core and the second conductive element and shields the internal components from external environment.

According to one aspect of the present invention, the first conductive element comprises a third core and a conductive wire spirally wound around the third core. The conductive wire generates heat when electricity is applied. Preferably, the third core is made of a cotton thread. Alternatively, any suitable flexible and non-conductive core materials may be used. The conductive wire is preferably made with copper having a non-conductive coating.

In the preferred embodiment, the first and second cores of the heating element are made of a non-conductive material with high heat transmitting coefficient. In particular, the first and second cores are made with silicone.

According to another aspect of the present invention, the heating element may be powered by a D/C voltage. In this regard, the electric blanket includes an A/C to D/C converter arranged between the control device and the heating pad to provide the D/C voltage to the heating pad.

According to another aspect of the present invention, the heating pad may have a shield arranged to cover the heating element. The shield is a wire mesh made of conductive wire or a conductive sheet, such as a conductive foil.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
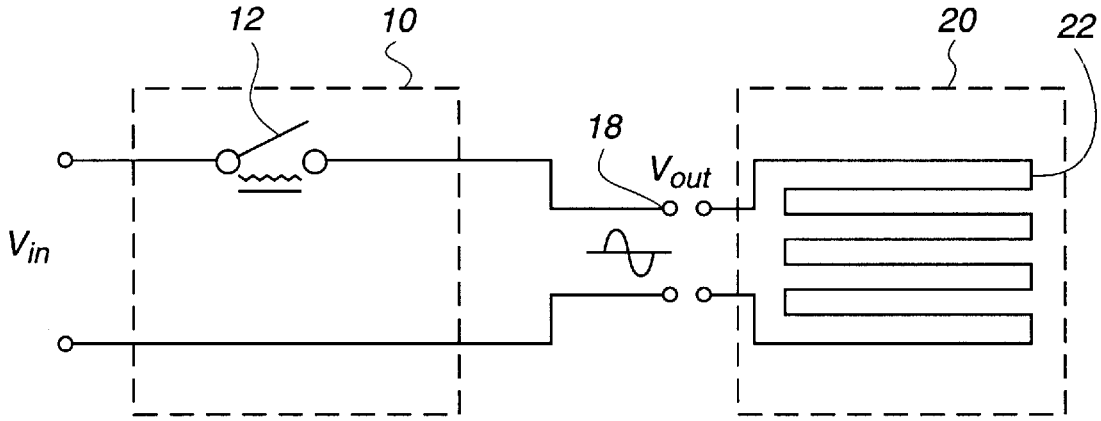
Fig. 1 (Prior Art)
FIG. 1 illustrates a schematic diagram of a prior art electric blanket.
Figure 2:
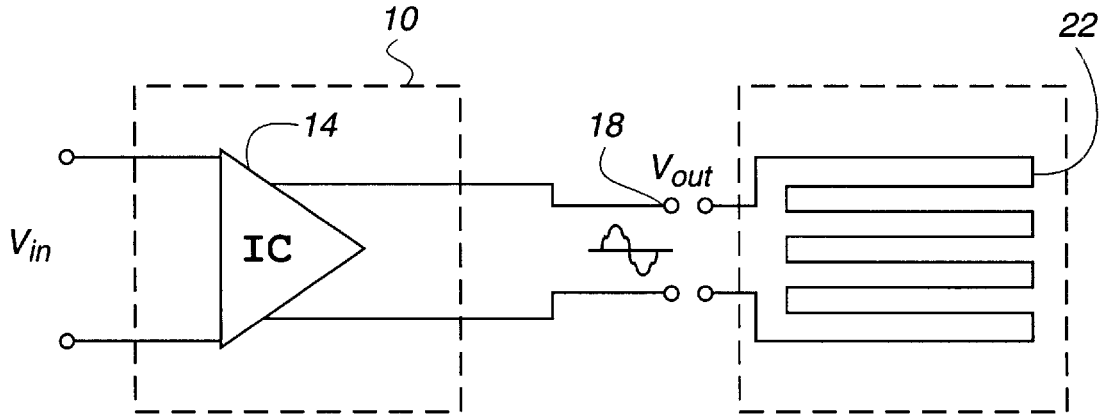
Fig. 2 (Prior Art)
FIG. 2 illustrates a schematic diagram of a prior art electric blanket using a different type of temperature controller.
Figure 3:
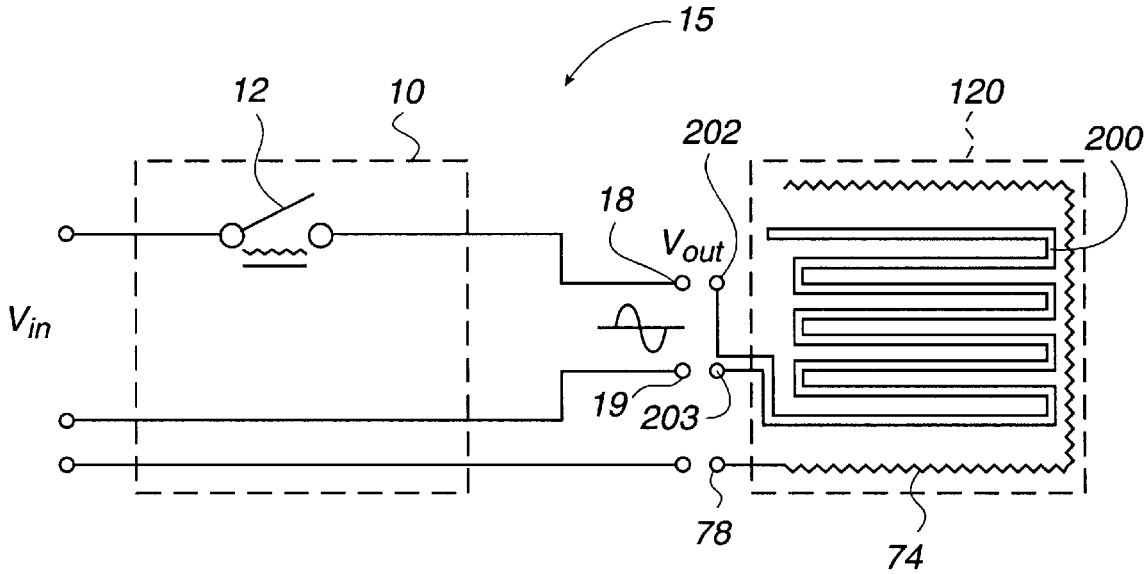
FIG. 3 illustrates a schematic diagram of the electric blanket according to the present invention using a bimetal temperature controller.

An electric blanket 15 generating reduced magnetic field according to preferred embodiments of the present invention is shown in the drawings for purposes of illustration. FIG. 3 shows a schematic diagram of the electric blanket 15 according to a first embodiment having a temperature controller 10, heating pad 120 which suppresses electromagnetic field and heating element 200 which suppresses magnetic field according to a preferred embodiment of the present invention. The temperature controller 10 is well known in the art and is provided to control the voltage between terminals 18 and 19 (denoted as Vout) with a thermal switch 12. The thermal switch 12 is designed and configured for a variable temperature setting by a user. The thermal switch 12 is preferably made of a bimetal, which is a laminate of two dissimilar metals having different coefficients of thermal expansion bonded together.

The output voltage from the temperature controller 10 (Vout), which typically is sinusoidal wave alternating current, is provided to inputs 202 and 203 of the heating pad 120. Alternatively, the output voltage from the temperature controller 10 may be provided to an energy-storage element (not shown) to smooth out the time variations of the waveform. This is achieved by capacitors and resistors. Capacitance and resistance of suitable values may be used dependent upon the line voltage Vin. More sophisticated filter circuits do better jobs of smoothing than capacitors.

The output voltage Vout provided to the heating pad 120 is converted into heat by the heating element 200. In particular, the heating element 200 of the present invention includes a resistive wire which produces heat when electrical current is provided. To reduce the electric field generated from the resistive wiring of the heating element 200, a shield 74 may be used, as shown in FIG. 3. In particular, the shield 74 is made preferably with copper mesh or other suitable forms and materials, such as aluminum foil, to substantially block the electric field emitted from the heating element 200.

Figure 4:
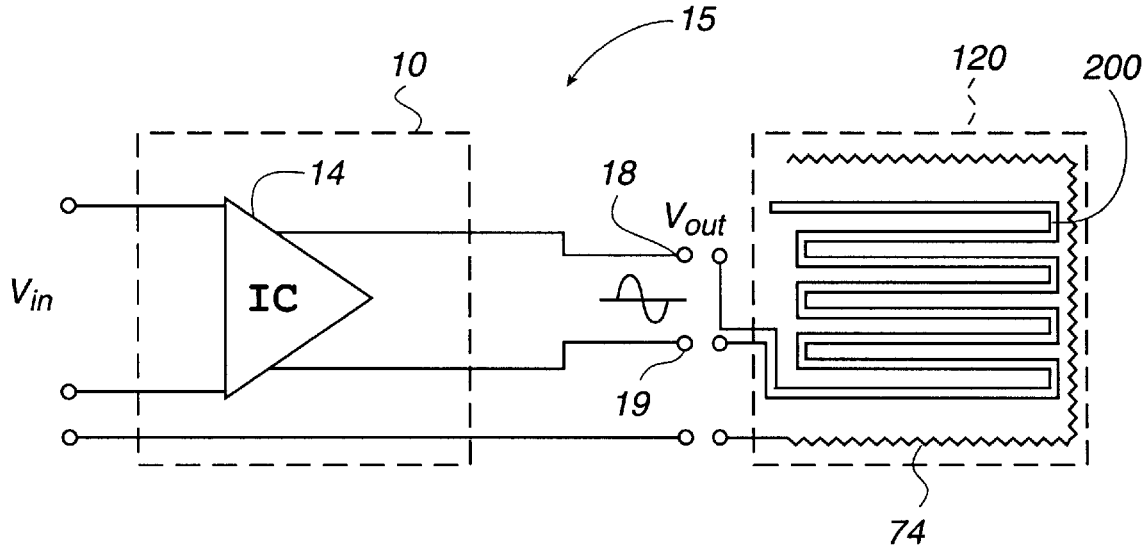
FIG. 4 illustrates a schematic diagram of the electric blanket according to the present invention using an IC temperature controller.

Alternatively, as shown in FIG. 4, the electric blanket 15 according to the present invention has a temperature controller 10 in the form of an integrated circuit switch 14 instead of the thermostat switch 12 to provide the same function. The heating pad 120 of the electric blanket 15 shown in FIG. 4 has the identical structure to that of FIG. 3.

Figure 5:
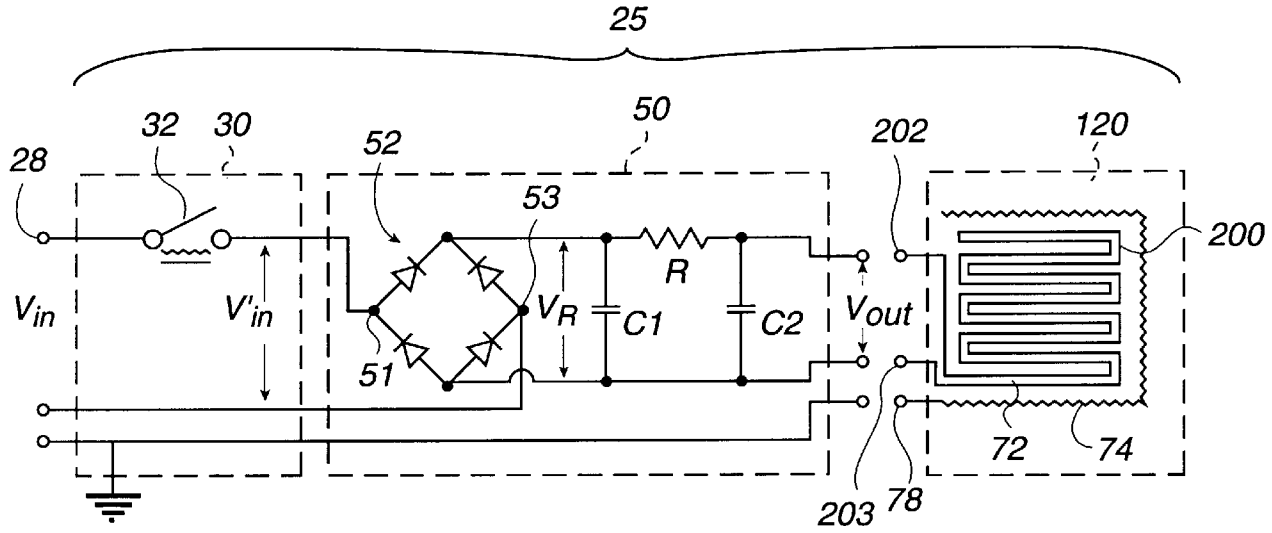
FIG. 5 illustrates a schematic diagram of the electric blanket using a D/C voltage to energize the heating pad.
Figure 6:
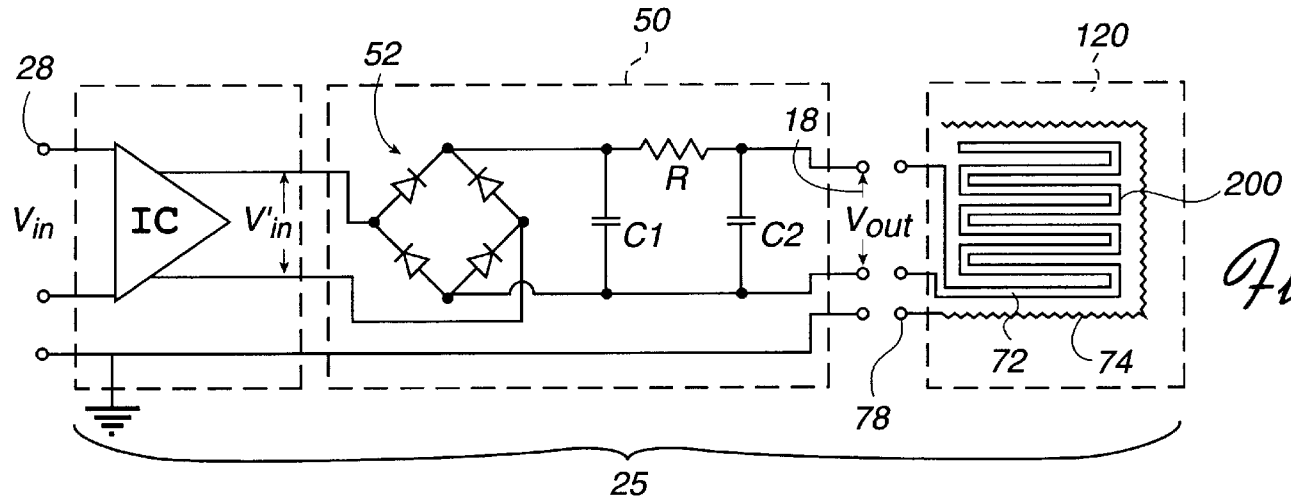
FIG. 6 illustrates a schematic diagram of another embodiment of the electric blanket using a D/C voltage to energize the heating pad.

FIGS. 5 and 6 show schematic diagrams of the electric blanket 25 according to a second embodiment of the present invention. While the electric blanket 15 shown in FIGS. 3 and 4 operate with alternating current, the electric blanket 25 of FIGS. 5 and 6 use direct current as its energy source. The electric blanket 25 includes a temperature controller 30, electromagnetic field suppressing device 50 and heating element 200. The temperature controller 30 is well known in the art and is provided to control the voltage between terminals 51 and 53 (denoted as V'in) with a thermal switch 32. The thermal switch 32 is designed and configured for a variable temperature setting by a user. The thermal switch 32 is preferably made of a bimetal, which is a laminate of two dissimilar metals having different coefficients of thermal expansion bonded together.

The output voltage from the temperature controller 30 (V'in), which is an alternating current, is provided to inputs 51 and 53 of a full-wave rectifier 52 comprising four diodes forming a ring as shown in FIG. 5. In this embodiment, a suitable full-wave rectifier 52 should be chosen to withstand a peak voltage in excess of the input line voltage Vin at node 28. The purpose of the full-wave rectifier 52 is to carry out AC to DC conversion for the purpose of supplying a constant voltage to the heating element 200. As an alternative embodiment of the present invention, a half-wave rectifier may be used in lieu of the full-wave rectifier 52. In particular, each diode of the full-wave rectifier 52 has a minimum operating range of about 3 amps and 250 to 400 volts, but other suitable diodes or the like may be used.

After converting the AC to DC using the full-wave rectifier 52, the next step involves an energy-storage element to smooth out the time variations of the rectified waveform. This is achieved by capacitors C1 and C2 and R. Capacitance and resistance of suitable values may be used dependent upon the line voltage Vin and operating characteristics of the full-wave rectifier 52. For example, in the second embodiment, for a line voltage Vin of 120V (which is a common household line voltage), the value of C1 and C2 may be about 100–200 $\mu$F and R may be about 2–5 ohms at 10 watts, but other suitable values can be used. More sophisticated filter circuits do better jobs of smoothing than capacitors. Alternatively, a regulator circuit (not shown) may be used in lieu of the resistor R for additional smoothing and to steadily maintain the DC voltage level despite variations of current demanded by the load.

The output voltage Vout provided to the heating pad 120 is converted into heat by the heating element 200. The construction of the heating pad 120 in FIGS. 5 and 6 is identical to one shown in FIGS. 3 and 4, and therefore, its description will not be repeated for the sake of brevity.

Figure 7:
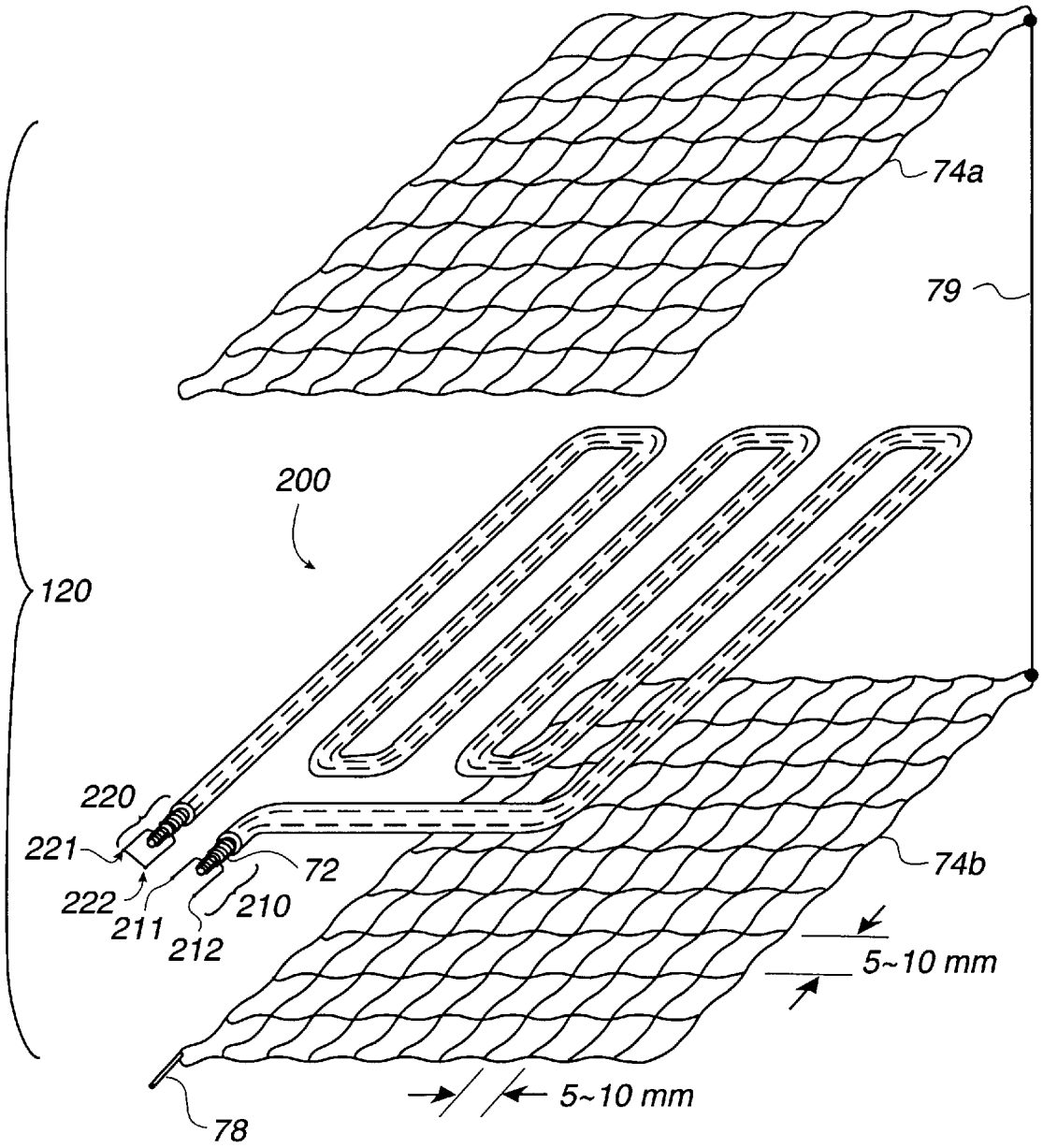
FIG. 7 illustrates a schematic diagram of the heating pad.

FIG. 7 illustrates the heating pad 120 of the present invention. The heating pad 120 includes a coaxial like heating element 200 preferably arrange between an upper shield 74*a* and a lower shield 74*b*. However, the heating pad 120 may only comprise the heating element 200 without the shields 74*a* and 74*b*. The heating element 200 is a resistive wiring which produces heat when electrical current is provided. Although the use of direct-current as a power supply to the heating element 200 reduces the effect of electromagnetic field, to further reduce the electromagnetic field generated from the heating element 200, a pair of shield 74*a* and 74*b* may be used, as shown in FIG. 7. In particular, the shields 74*a* and 74*b* are made preferably with copper or other suitable materials to substantially block the electromagnetic field emitted from the heating element 200. The shields 74*a* and 74*b* may take many forms and shapes. The shields 74*a* and 74*b* shown in FIG. 7 is in the form of a mesh. Other suitable type of shields known to one of ordinary skill in the art may be used, such as thin aluminum or copper foil. The shields 74 are then covered with a fabric material, such as cotton. The whole assembly may then be covered with a resilient fabric to form a blanket or a comforter.

The shields 74*a* and 74*b*, which are preferably made with thin copper wires is webbed to form a substantially flat and flexible mesh. In the preferred embodiment, the conductive wire of the shields 74*a* and 74*b* consists of a multiple, such as five (5), strands of twisted conductive wires, each wire having a diameter of about 0.005 mm, for increased resiliency and flexibility. The shields 74*a* and 74*b* are positioned so that the first shield 74*a* is preferably above and the second shield 74*b* is below the heating element 200. The purpose of a connecting wire 79 is to illustrate that the first shield 74*a* and the second shield 74*b* are electrically connected to each other. Preferably, when the heating element 200 is constructed, the first and second shields 74*a* and 74*b* may be joined at the edges to form a fully conducting envelope where the resistive wiring 72 can be inserted. The terminal 78 is preferably connected to the ground to discharge any current build-up from electromagnetic field and/or static electricity. This way the possibility of electric shock by an exposed wire in the heating element 200 is eliminated because such wire cannot be exposed without it being short circuited by the shield 74*a* or 74*b*.

In the first and second shields 74*a* and 74*b*, the gap between each thread of wire may be adjusted dependent upon the frequency of the electromagnetic field generated from the heating element 200. For example, if the present invention is used with 120V line voltage at 60Hz, then the gap between each wire should preferably be about 5 to 10 mm. In an alternative embodiment of the present invention, the shield 74 may be made of a flexible foil or a cloth sprayed or coated with a conductive material.

FIG. 7 also shows the heating element 200 according to the preferred embodiment of the present invention. The coaxial type heating element 200 is arranged in a zig-zag form between two shields 74*a* and 74*b*. As an added comfort, one or more layers of cloth or fabric materials may be inserted between the heating element 200 and the shields 74*a* and 74*b*. The heating element 200 includes an input portion 210 and a terminating portion 220. Both portions are shown as exposed in FIG. 7 for the purpose of describing their embodiments. However, during actual use, the both ends of the heating element 200 are preferably covered with any suitable protective cover to prevent short circuiting of internal conductive wires.

The input portion 210 of the heating element 200 has two input leads 211 and 212 for receiving electric current thereto. The terminating portion 220 also has two leads 221 and 222 which are connected to each other to complete a conductive loop defining the heating element 200. The detailed description of the heating element will be de(scribed with respect to FIGS. 8–9.

Figure 8:
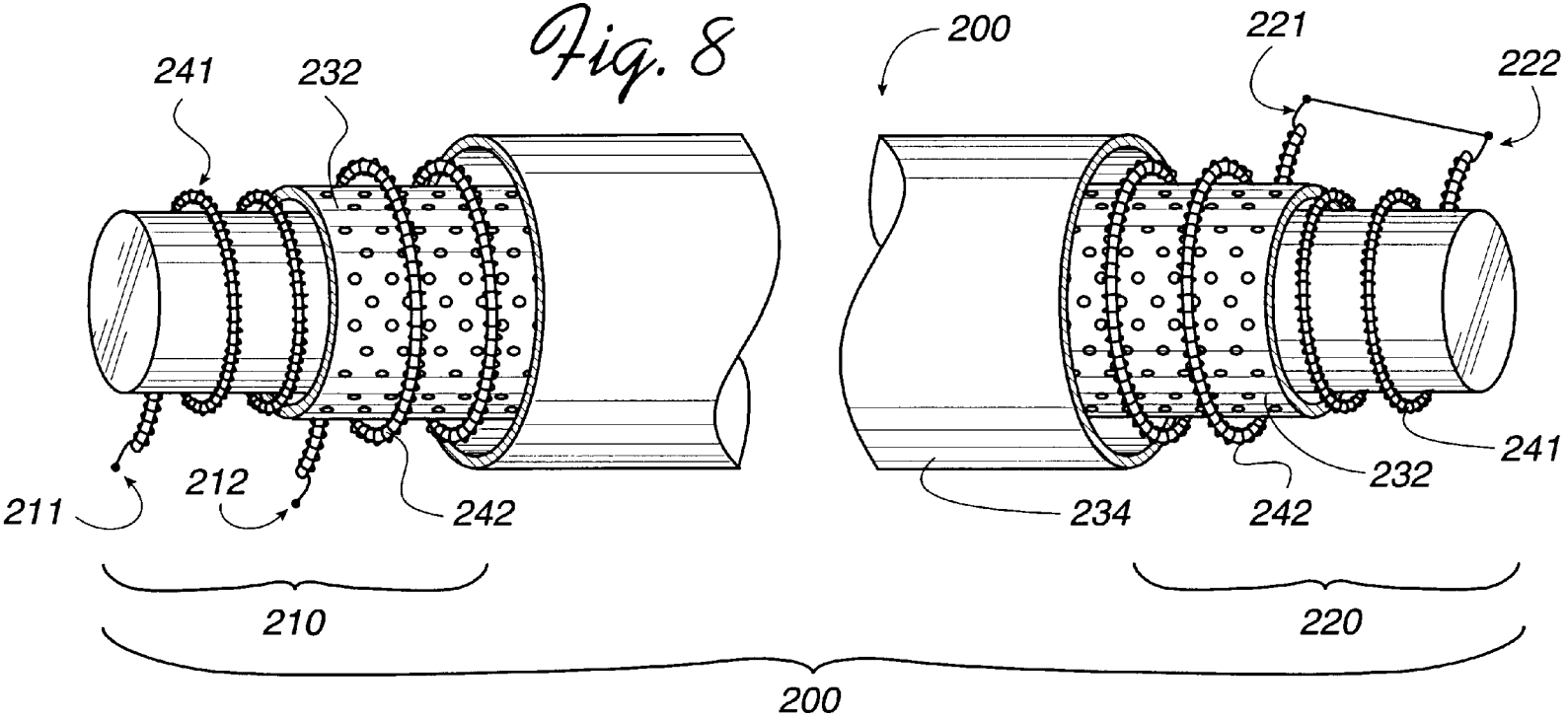
FIG. 8 illustrates the heating element according to the present invention.

FIG. 8 illustrates the input portion 210 and the terminating portion 220 of the heating element 200 according to the present invention. The heating element 200 includes a first core 230, a second core 232 arranged in a surrounding relation and preferably completely covering the first core, and a protective cover or layer 234 covering both the first and second cores 230 and 232. The first and second cores 230 and 232 and the protective cover 234 are preferably made with any suitably flexible and resilient material, such as silicone, rubber or plastic composite material. Preferably, the materials used for the first and second cores 230 and 232 and the protective cover 234 should be made with a heat conductive material or materials that have a high heat transmission coefficient.

Using the first core 230 as an axis, a first resistive wire or heating wire 241 is firmly and spirally wrapped around the first core 230. When spirally wrapped, the separation distance between the first resistive wire 241 may depend on the input frequency and the voltage to effectively cancel the magnetic field generated from a second resistive wire 242. The first core 230 and the first resistive wire 241 are then covered with the second core 232. Using the second core 232 as an axis, a second resistive wire or heating wire 242 is firmly and spirally wrapped around the second core 232. When spirally wrapped, the separation distance between the second resistive wire 242 depends on the input frequency and the voltage to effectively cancel the magnetic field generated from the first resistive wire 241. Preferably, the first and second resistive wires 241 and 242 are identical. The entire structure is then coated with the protective cover 234 to shield from outer environment. The number of windings of either the first resistive wire 241 or the second resistive wire 242 may preferably be about 20 to 100 turns per inch. Such number of turns eliminates about 90% of magnetic field generated from the wires.

As shown in the terminating portion 220 of the heating element 200, the two leads 221 and 222 are connected to each other. In such construction, the resistive wires 241 and 242 become one continuous heating wire.

Figure 9:
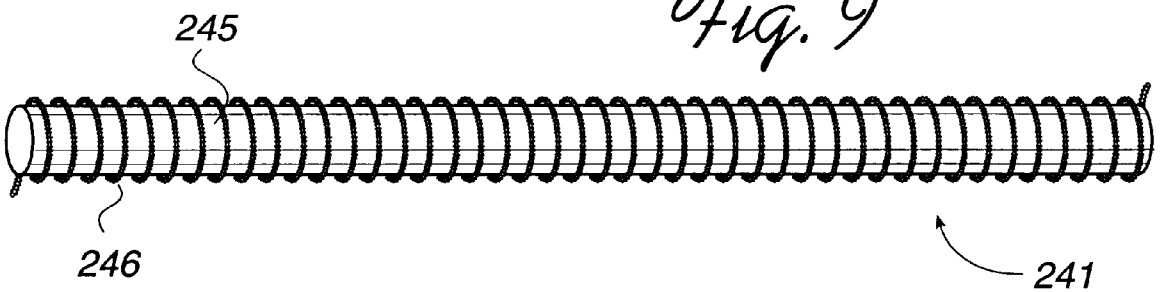
FIG. 9 illustrates a resistive wire used in the heating element of the present invention.

FIG. 9 illustrates one embodiment of the first resistive wire 241. The first resistive wire 241 includes a flexible core 245 and a copper wire 246 spirally wrapped around the core 245 using the core 245 as an axis. The core 245 is preferably made with cotton, nylon or other suitable insulating materials. the copper wire 246 is a type which is coated with a non-conductive coating to prevent short circuiting. Because the copper wire 246 is densely wrapped around the core 245, more heat can be generated from such resistive wire 241 than when a straight copper wire is used. A copper wire 246 having a different thickness (e.g., a thicker wire) may be used to generate more heat or to accommodate higher wattage. As an alternative embodiment, a straight copper wire may be used as the first and second resistive wire 241 and 242. In such a case, the straight copper wire is directly wound on the first and second cores 230 and 232, respectively.

Figure 10:
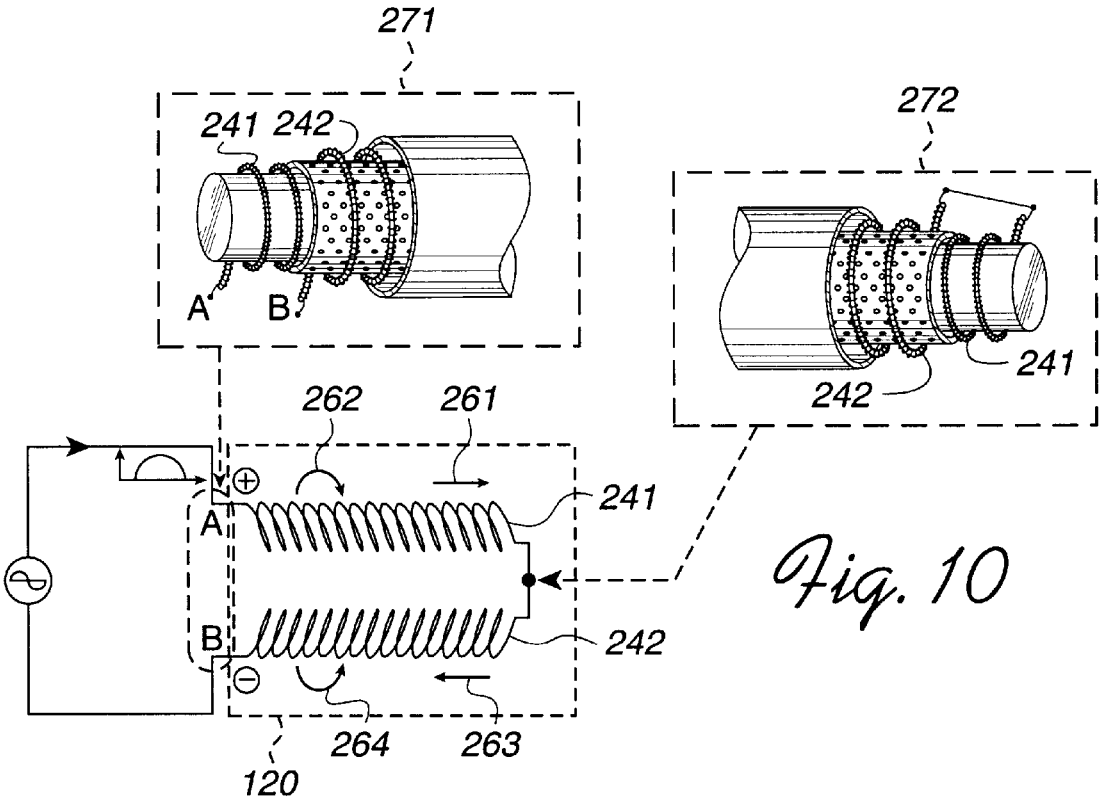
FIGS. 10 and 11 illustrate current and magnetic field direction in the heating element according to the present invention.
Figure 11:
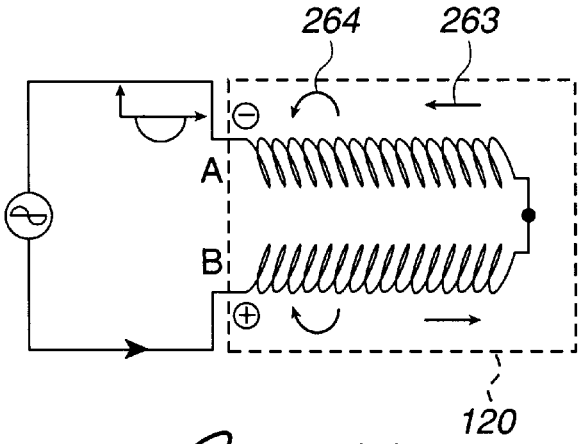

The operation of the present invention will now be described with respect to FIGS. 10 and 11. FIGS. 10 and 11 illustrate the current and magnetic field direction of the electric blanket according to the present invention when alternating current is used as an input source. In particular, FIG. 10 illustrates such current and magnetic field direction when a positive voltage is applied to the heating element 120, while FIG. 11 illustrates such current and magnetic field direction when a negative voltage is applied.

A diagram 271 illustrates the input portion 210 of the heating element and a diagram 272 illustrates the terminating portion 220. The current arrow 261 represents the direction of the current, while the magnetic field arrow 262 represents the direction of the magnetic field according to the right-hand rule.

When the current flows from left to right in the first resistive wire 241 as in FIG. 10, the magnetic field direction in the first resistive wire 241 is in a clockwise direction as indicated by the arrow 262 in accordance with the right-hand rule. Because the first and second resistive wires 241 and 242 are connected at the terminating portion of the heating element, as shown in diagram 272, the current in the second resistive wire 242 flows from right to left which is denoted by current arrow 263 shown in FIGS. 10 and 11. As a result, the magnetic field direction in the second resistive wire 242 is in a counter-clockwise direction as indicated by the arrow 264. Therefore, the clockwise magnetic field generated by the first resistive wire 241 effectively and substantially cancels the counter-clockwise magnetic field generated by the second resistive wire 242. Consequently, the heating element 200 according to the present invention produces either no or very low magnetic field.

The above description in connection with FIG. 10 equally applies to the diagram shown in FIG. 11, except that the directions of current and the magnetic field are all reversed. However, the theory of operation remains the same.

Although the above description has been provided using an electric blanket as an example, the present invention may be used in electric heating pad, comforter, etc.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electric blanket for use with an ungrounded source voltage, comprising:

a control device connected to the source voltage to control the source voltage in response to a predetermined temperature setting; and a heating pad having a heating element arranged in the heating pad and connected to an output of the control device to generate heat, the heating element including:

a first core;

a first conductive element wound around the first core using the first core as an axis;

a second core arranged in surrounding relation to the first core and the first conductive element; and a second conductive element wound around the second core using the second core as an axis, wherein the first and the second conductive elements are electrically connected to each other at one end and are connected to the ungrounded source voltage at the other end to at least partially cancel out magnetic field generated from each conductive element.

2. The electric blanket of claim 1, the heating element further comprising an outer cover that covers the second core and the second conductive element.

3. The electric blanket of claim 1, wherein each one of the first and second conductive elements comprises:

a third core;

a conductive wire wound around the third core using the third core as an axis, wherein the conductive wire generates heat when electricity is applied.

4. The electric blanket of claim 3, wherein the third core is made of a cotton strand.

5. The electric blanket of claim 3, wherein the conductive wire is made with copper having a non-conductive coating.

6. The electric blanket of claim 1, wherein the first and second cores are made of a non-conductive material with a high heat transmitting coefficient.

7. The electric blanket of claim 6, wherein the first core is made with silicone.

8. The electric blanket of claim 6, wherein the second core is made with silicone.

9. The electric blanket of claim 1, the electric blanket further including an A/C to D/C converter arranged between the control device and the heating pad to provide a D/C voltage to the heating pad.

10. The electric blanket of claim 1, the heating pad further comprising a shield arranged to cover the heating element, wherein the shield is a wire mesh made of conductive wire.

11. The electric blanket of claim 1, the heating pad further comprising a shield arranged to cover the heating element, wherein the shield is a conductive sheet.

12. The electric blanket of claim 1, wherein first ends of the first and second conductive elements are connected to the output of the control device and the second ends are connected to each other to define a conductive loop.

13. A heating element for use in an electric blanket with a source voltage, the heating element comprising:

a first core;

a first conductive element wound around the first core using the first core as an axis;

a second core arranged in surrounding relation to the first core and the first conductive element; and a second conductive element wound around the second core using the second core as an axis, wherein the first and the second conductive elements are electrically connected to each other at one end and are connected to the source voltage at the other end.

14. The heating element of claim 13, the heating element further comprising an outer cover that covers the second core and the second conductive element.

15. The heating element of claim 13, wherein each one of the first and second conductive elements comprises:

a third core;

a conductive wire wound around the third core using the third core as an axis, wherein the conductive wire generates heat when electricity is applied.

16. The heating element of claim 15, wherein the third core is made of a cotton strand.

17. The heating element of claim 15, wherein the conductive wire is made with copper having a non-conductive coating.

18. The heating element of claim 13, wherein the first and second cores are made of a non-conductive material with a high heat transmitting coefficient.

19. The heating element of claim 18, wherein the first core is made with silicone.

20. The heating element of claim 19, wherein the second core is made with silicone.

* * * * *